US008484813B2

(12) United States Patent
Taniguchi et al.

(10) Patent No.: US 8,484,813 B2
(45) Date of Patent: Jul. 16, 2013

(54) SNAP BUTTON

(75) Inventors: Katsuhide Taniguchi, Tokyo (JP); Saori Suzuki, Tokyo (JP)

(73) Assignee: YKK Corporation (JP)

( * ) Notice: Subject to any disclaimer, the term of this patent is extended or adjusted under 35 U.S.C. 154(b) by 181 days.

(21) Appl. No.: 13/147,813

(22) PCT Filed: Feb. 23, 2009

(86) PCT No.: PCT/JP2009/053211

§ 371 (c)(1),
(2), (4) Date: Aug. 4, 2011

(87) PCT Pub. No.: WO2010/095266

PCT Pub. Date: Aug. 26, 2010

(65) Prior Publication Data

US 2011/0283496 A1 Nov. 24, 2011

(51) Int. Cl.
*A44B 17/00* (2006.01)

(52) U.S. Cl.
USPC ..... 24/586.11; 24/114.05; 24/114.4; 24/90.1; 24/594.11

(58) Field of Classification Search
None
See application file for complete search history.

(56) References Cited

U.S. PATENT DOCUMENTS

| | | | | | |
|---|---|---|---|---|---|
| 1,321,974 | A | * | 11/1919 | Bourque | 24/630 |
| 2,867,025 | A | * | 1/1959 | Aler | 24/590.1 |
| 4,486,918 | A | * | 12/1984 | Peebles | 16/422 |
| 4,819,309 | A | * | 4/1989 | Behymer | 24/586.11 |
| 4,878,792 | A | * | 11/1989 | Frano | 411/339 |
| 4,982,480 | A | * | 1/1991 | Kasai | 24/586.11 |
| 5,250,058 | A | * | 10/1993 | Miller et al. | 606/154 |
| 5,308,671 | A | * | 5/1994 | Wells | 428/99 |
| 5,657,516 | A | * | 8/1997 | Berg et al. | 24/452 |
| 6,353,978 | B1 | * | 3/2002 | Kawahara et al. | 24/114.4 |
| 6,401,308 | B1 | * | 6/2002 | Kawahara | 24/114.4 |
| 6,497,003 | B2 | * | 12/2002 | Calabrese | 16/4 |
| 6,666,873 | B1 | * | 12/2003 | Cassell | 606/153 |
| 6,757,942 | B2 | * | 7/2004 | Matsui et al. | 24/114.4 |
| 7,150,081 | B2 | * | 12/2006 | Juan | 24/584.1 |

(Continued)

FOREIGN PATENT DOCUMENTS

| | | | |
|---|---|---|---|
| DE | 2221287 | A | 11/1972 |
| EP | 0292892 | A1 | 11/1988 |

(Continued)

OTHER PUBLICATIONS

International Search Report and Written Opinion, PCT International Patent Application No. PCT/JP2009/053211, mailed May 26, 2009.

*Primary Examiner* — Jack W. Lavinder
(74) *Attorney, Agent, or Firm* — Kilpatrick Townsend & Stockton LLP

(57) ABSTRACT

A snap button is provided, which can function as both of a male snap and a female snap without accurate alignment or positioning two snap buttons to be engaged with each other. The snap button comprises a button body, wherein the button body includes a plurality of projections and a plurality of recesses, which are circumferentially alternately arranged. Each of the projections includes at least one salient and each of the recesses includes at least one protrusion. Each of the projections may be shaped as a horizontal cross-section thereof gradually decreases from the proximal end to the distal end. Further, the circumferential range of each recess is larger than that of each projection. The protrusion may have one or more cutouts, and the salient may be hemispherically shaped.

7 Claims, 4 Drawing Sheets

U.S. PATENT DOCUMENTS

| | | | | |
|---|---|---|---|---|
| 7,395,584 | B2 * | 7/2008 | Khalifa et al. | 24/590.1 |
| 7,490,386 | B2 * | 2/2009 | Raccosta | 24/114.9 |
| 8,239,970 | B2 * | 8/2012 | Ikeda | 2/414 |
| 2003/0196300 | A1 * | 10/2003 | Matsui et al. | 24/114.4 |
| 2004/0025306 | A1 * | 2/2004 | Coffey | 24/114.05 |
| 2007/0125947 | A1 * | 6/2007 | Sprinzak et al. | 250/310 |
| 2011/0113600 | A1 * | 5/2011 | Hasegawa | 24/594.11 |

FOREIGN PATENT DOCUMENTS

| | | | |
|---|---|---|---|
| EP | 1084641 | A2 | 3/2001 |
| JP | 6-31929 | Y2 | 8/1994 |
| JP | 8-294405 | A | 11/1996 |
| JP | 2000-270906 | A | 10/2000 |
| JP | 2001-78809 | A | 3/2001 |
| JP | 2004-129985 | A | 4/2004 |

* cited by examiner

SNAP BUTTON

This application is a national stage application of PCT/JP2009/053211, which is incorporated herein by reference.

BACKGROUND OF THE INVENTION

The present invention relates to a snap button used for clothes, bags and the like, more particularly, to a snap button which can function as both of a male snap and a female snap.

In general, a snap button is used as a pair of a male snap and a female snap, where the male snap has a projection and the female snap has a recess for detachably receiving the projection of the male snap. Therefore, between the male and the female snaps, steps of manufacture, inventory management, attachment to cloths, etc. are different. To improve this matter, Japanese Examined Utility-Model H06-31929 discloses a technology in which one sort of a snap button can be used as both of a male snap and a female snap. The snap button disclosed in the document includes a pair of male pieces and a pair of female pieces both of which project from a disk-shaped button body. In use, the pair of the male pieces of one of two same snap buttons are fitted between the pair of the female pieces of the other button.

In the snap button disclosed in the document, when the two snap buttons are engaged with each other, it is necessary not only to accurately align the axis of one of the two snap buttons with the axis of the other but also to adjust the circumferential positions of the two snap buttons so as to match the pair of the male pieces of one of the two snap buttons with the pair of the female pieces of the other. Therefore, the act of engaging the two snap buttons has to be performed very carefully. In addition, when the two snap buttons are attached to cloths, they have to be fixed in proper and accurate circumferential positions, which makes the work of attaching buttons to cloths difficult.

In view of the problems as mentioned above, an object of the present invention is to provide a snap button which can function as both of a male snap and a female snap without accurate alignment or positioning two snap buttons to be engaged with each other.

[Patent document 1] Japanese Examined Utility-Model H06-31929

SUMMARY OF THE INVENTION

According to the present invention, there is provided a snap button made of resin which can function as both a male snap and a female snap to be used in a pair, comprising a plate-like button body; wherein the button body includes a plurality of projections projecting from a surface of the button body and a plurality of recesses recessed from the surface to detachably receive the projections of a separate and same snap button, the projections and the recesses being circumferentially alternately arranged with respect to the center of the button body; a circumferential range of each of the recesses is larger than that of each of the projections; each of the projections includes at least one salient protruding radially inward at a projecting end portion of each projection; and each of the recesses includes at least one protrusion protruding radially outward at a radially inner side of an opening of each recess to engage with the salient of each projection of the separate and same snap button when the recesses receives the projections, the opening being open on the surface of the button body.

The snap button according to the present invention is used as a pair of two same snap button. The two snap buttons are attached to clothes etc. using separate attaching members, and the projections and the recesses of one of the two snap buttons are engaged and disengaged with the recesses and the projections of the other snap button, respectively. In the present invention, the circumferential range of each recess is larger than that of the proximal end of each projection. The circumferential range of each projection is maximal at its proximal end. Therefore, when the projections of one of the two snap buttons are matched with the recesses of the other button, it is easy to position the top of each projection within the range of the opening of each recess, and it is unnecessary to strictly positioning circumferentially the two snap buttons when they are engaged with each other. The number of the projections provided in the snap button is preferably two, but it may be three or more, and the same is true of the recesses. Though the recess is recessed from the surface of the button body, the recess may be a bottomless through hole penetrating the button body. Though the shape of the button body is generally a circle or a polygon close to a circle, it may be a rectangle and the like. As described later, the projection is preferably projected from the surface of the button body (i.e., the proximal end of the projection) while a horizontal cross-section of the projection gradually decreases. However, not limited to this, the projection may be projected from its proximal end to its distal end with a uniform horizontal cross-section.

According to an embodiment of the present invention, each of the projections is projected from the surface of the button body while a horizontal cross-section of each projection gradually decreases.

As a result, each projection is tapered off from the proximal end to the distal end, which makes it easy to match each projection with each recess. Further, with the tapered projection, it is possible to secure a large cross-section of the projection at the proximal end, which can ensure the strength of the projection. A specific shape of the projection is, for example, as follows: That is, the projection may comprise a projection body having an inward face facing radially inward, an outward face facing radially outward, and bilateral side faces between the inward and outward faces; and the salient protruding from an upper end portion of the inward face of the projection body. Here, the outward face may be inclined as gradually closing to the inward face from the proximal end (base end) to the distal end (projecting end), and the bilateral side faces may be inclined so as to be gradually close to each other from the proximal end to the distal end. However, the shape of the projection is not limited to such a shape. By making the outward face and the bilateral side faces inclined, when matching the projection with recess, even if those inclined faces hit an edge etc. of the opening, the matching action would be smoothly done without obstruction due to the hit.

In the present invention, the radially inner side of the opening may have a chamfered portion. The slope of the chamfered portion can serve as a guide to introduce the projection into the recess, when the projection hits the chamfered portion on the way into the recess to match with.

Further, in the present invention, a radially outer face of the recess may be an inclined face inclined radially outward toward the surface of the button body. The radially outer slope of the recess can serve as a guide to introduce the projection, which hit the slope, into the recess while positioning the two snap buttons concentrically, when matching the projection with the recess.

In the present invention, the protrusion may have one or more cutouts. When the two snap buttons are engaged and disengaged, the salients of one of the snap buttons and the protrusions of the other come into contact with each other and elastically deformed, and then they are restored just after mutually passing over. The cutouts can make the protrusion more elastic or flexible, decreasing a force required for the engaging and disengaging actions between the two snap buttons. Besides, the cutouts may be slits and the like.

In the present invention, the salient may be hemispherically shaped. The hemispheric salient can more easily pass over the protrusion, decreasing a force required for the engaging and disengaging actions between the two snap buttons.

In the present invention, the circumferential range of each recess is larger than that of each projection, and therefore, when the projections of one of the two snap buttons are matched with the recesses of the other button, it is easy to position each projection with respect to each recess. Further, with the projection tapered off from the proximal end to the distal end, it is easier to position the projection with respect to the recess. Furthermore, with the one or more cutouts in the protrusion and the hemispheric salient, their slopes can serve as a guide to introduce the projection into the recess to match with, even if the axes of the two snap buttons are not aligned.

BRIEF DESCRIPTION OF THE DRAWINGS

FIG. 10 is a partial perspective view showing a modified example of a salient.

DETAILED DESCRIPTION OF THE INVENTION

Figure 1:
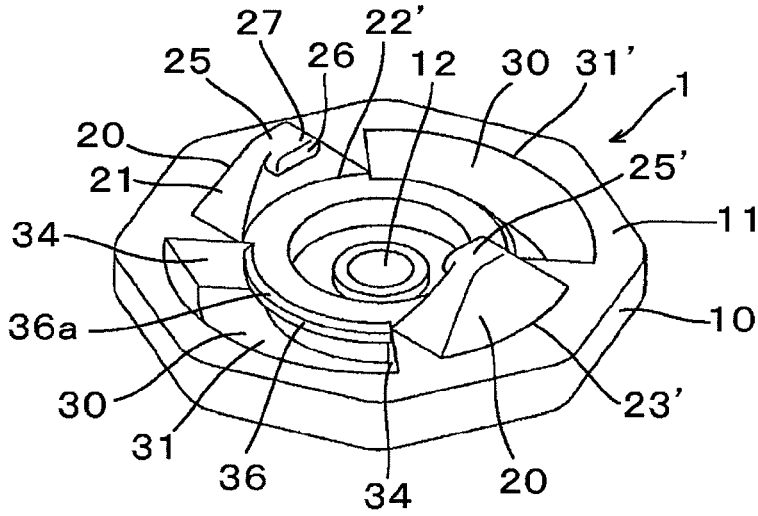
FIG. 1 is a perspective view of a snap button according to an embodiment of the present invention.
Figure 2:
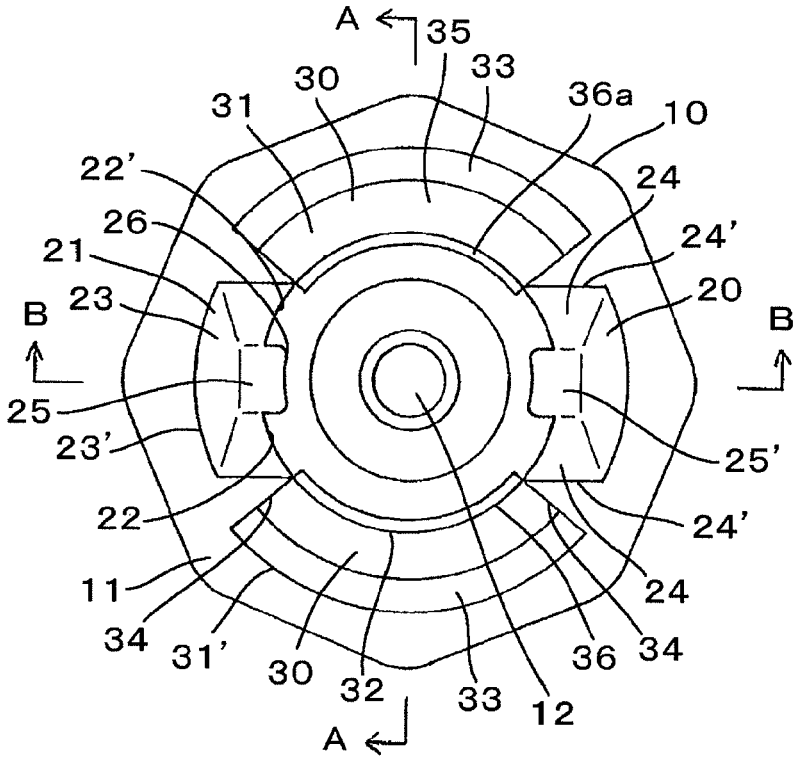
FIG. 2 is a plane view of the snap button shown in FIG. 1.
Figure 3:
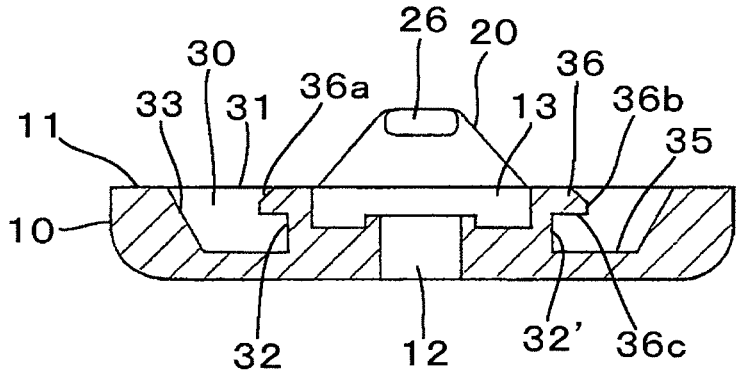
FIG. 3 is a sectional view taken along line A-A in FIG. 2.
Figure 4:
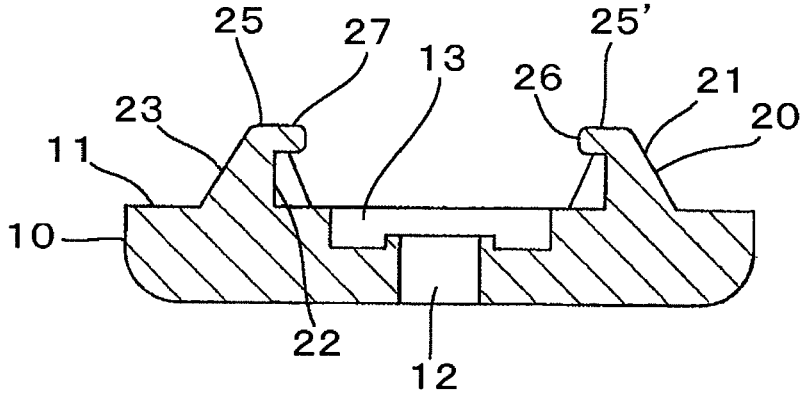
FIG. 4 is a sectional view taken along line B-B in FIG. 2.

Hereinafter, preferred embodiments of the invention will be described with referring to the drawings. FIGS. 1 and 2 are a perspective view and a plane view of a snap button 1 which can function as both of a male snap and a female snap according to an embodiment of the present invention. FIGS. 3 and 4 are sectional views taken along line A-A and line B-B in FIG. 2, respectively. The snap button 1, which is a molded resinous product, comprises a button body 10 having an octagonal disk-like shape, for example. To an upper surface 11 (the upper and lower directions are based on FIG. 4) of the button body 10, concavity and convexity such as projections 20 and recesses 30 as described later are formed. The button body 10 includes a axially through hole 12 at the center portion thereof for receiving a post 42 of an attaching member 40 (see FIG. 5 etc.) as mentioned later when the snap button 1 is attached to a cloth. Above the hole 12, there is provided a circular depression 13 concaved from the upper surface 11 for receiving a swaged upper end portion 43'(see FIG. 6 etc.) of the post 42 of the attaching member 40 after having passed through the hole 12. On the upper surface 11 of bottom body 11, there are formed two projections 20 projecting upward from the surface 11. The projections 20 are arranged radially outward from the depression 13 and oppositely in a diameter direction (hereinafter referred to as "the inter-projection diameter") with the hole 12 placed between the projections 20. Further, the bottom body 11 includes two recesses 30 recessed downward from the surface 11, each of which is arranged alternately with and closely to each projection 20 circumferentially. Here, one projection 20 and one recess 30 occupy 180 degrees in the circumferential direction, and a circumferentially occupying range of one recess 30 is larger than that of one projection 20 as described later in detail.

Each of the projections 20 includes a projection body 21 and a salient 26 protruding radially inward from an upper end portion of an after-mentioned inward face 22 of the projection body 21. The projection body 21 has a shape of which a horizontal cross-section as being generally sector form is gradually decreased from the base end (proximal end) abutting the surface 11 of the button body 10 to the upper projecting end (distal end). The projection body 21 has the inward face 22 facing radially inward which is a circularly curved concave surface having a generally trapezoidal form, an outward face 23 facing radially outward which is a circularly curved convex surface having a generally trapezoidal form, bilateral (in counterclockwise and clockwise directions circumferentially) side faces 24,24 having generally trapezoidal, an upper face 25 having generally rectangle form. The side faces 24 and the upper face 25 connect between the outlines of the inward and outward faces 22 and 23. As can be seen from FIG. 4 etc., the inward face 22 is vertical to the horizontal direction or a horizontal plane, and the outward face 23 is inclined as gradually closing to the inward face 22 from the base end to the projecting end. Each side face 24 has the base end edge 24', which are in parallel to the inter-projection diameter. The bilateral side faces 24 are inclined so as to be gradually close to each other from the base end to the projecting end while maintaining being parallel to the inter-projection diameter. The salient 26 has a horizontally long and generally rectangular shape with its edge rounded. An upper face 27 of the salient 26 is flush with the upper face 25 of the projection body 21. The upper face 25 of the projection body 21 and the upper face 27 of the salient 26 define a top 25' of the projection 20.

Each of the recesses 30 has a sector form in a horizontal cross-section and is open on the surface 11 of the button body 10 as a sector-shaped opening 31. Each recess 30 is defined by a radially inner side 32 extending along the circumferential direction, a radially outer side 33, bilateral sides 34, 34 connecting between the bilateral ends of the inner and outer sides 32 and 33, and a horizontal bottom 35. The outer side 33 is inclined radially outward from the bottom 35 to the opening 31. Each bilateral side 34 is vertical to the horizontal direction and along a corresponding diameter direction. The inner side 32 includes a lower face 32' vertically rising from the bottom 35 and an upper protrusion 36 protruding radially outward with respect to the lower face 32'. The protrusion 36 circumferentially extends all over the inner side 32, and has an underside 36*c* vertical to the lower face 32', a protruding end 36*b* vertical to the underside 36*c*, and a chamfered portion 36*a* chamfered obliquely between the protruding end 36*b* and the surface 11 of the button body 10. The chamfered portion 36*a* appears at the radially inner side of the opening 31. The boundary between the surface 11 and the chamfered portion 36*a* is positioned radially outward from the lower 32'.

With referring to FIG. 2, the circumferential range of each recess 30 is set to be larger than the circumferential range of each projection 20. More specifically, while the angle ranging between the bilateral sides 34,34 of one recess 30 is set to be approximately 100 degrees, the angle ranging between bilateral ends of the base end edge 22' of the inward face 22, which is the circumferentially longest part in one projection 20 is set to be approximately 80 degrees. Each of the bilateral ends of the base end edge 22' of one projection 20 is tightly adjacent to one of the bilateral sides 34, 34 of one of adjacent recesses 30. The radial position of the inward face 22 of each projection 20 is at approximately the same as that of the protruding end 36*b* of the protrusion 36 in each recess 30. Further, the base edge 23' of the outward face 23 of each projection 20 is positioned at radially inward rather than the radially outer side arc 31' (the upper end edge of the outer side 33) of the opening 31 in each recess 30. Furthermore, the radially inward protruding height of the salient 26 from the inward face 22 is slightly smaller than the radially outward protruding height of the protrusion 36 from the lower face 32' in the recess 30.

Figure 5:
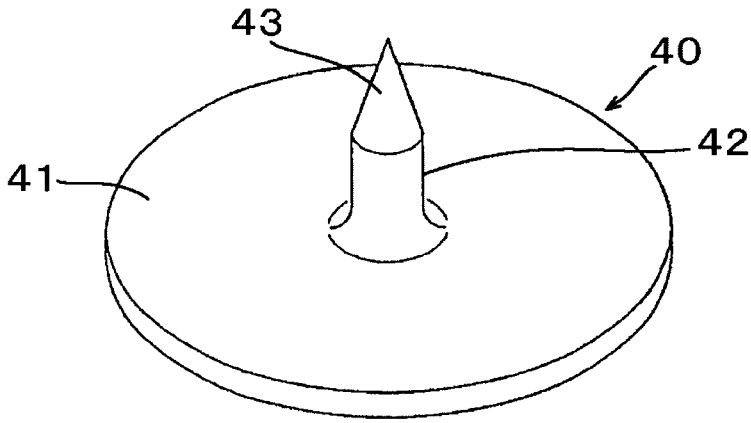
FIG. 5 is a perspective view of an attaching member for attaching the snap button to a cloth.

FIG. 5 is a perspective view of a resin-made attaching member 40 to attach the snap button 1 to a cloth. The attaching member 40 is a conventional and includes a disk-like base 41 and a post 42 projecting from the base 41 along the axis of the member 40. The upper end portion 43 of the post 42 is tapered off to the tip. With referring to FIG. 6, when the snap button 1 is attached to a cloth f using the attaching member 40, after the post 42 pierces the cloth f from the opposite side to the snap button 1 and then passes through the hole 12 of the snap button 1, the upper end portion 43 of the post 42 is swaged. As a result, the portion 43 is axially compressed and radially expanded to be a deformed or swaged portion 43'. The swaged portion 43' is received in the depression 13 of the button body 10 and is unable to pass through the hole 12.

Figure 6:
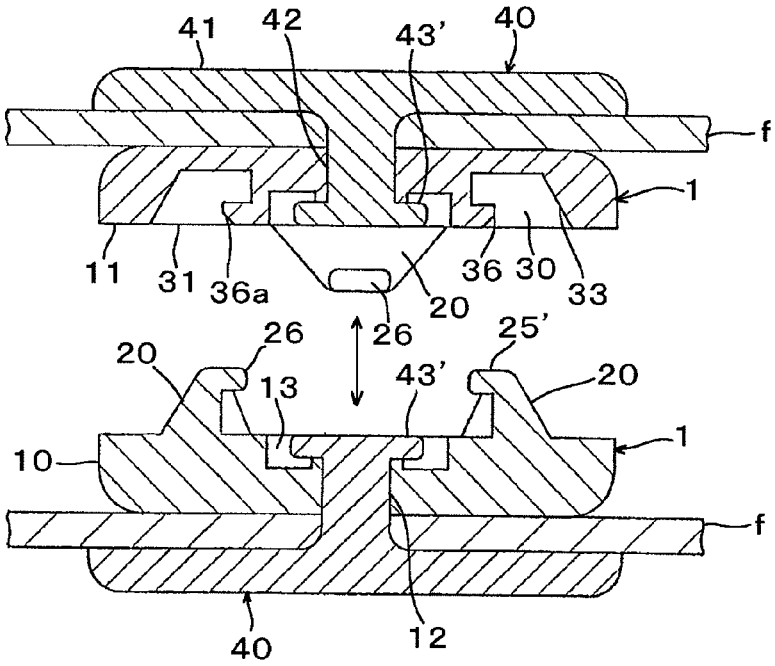
FIG. 6 is a sectional view illustrating a state just before two snap buttons are engaged.
Figure 7:
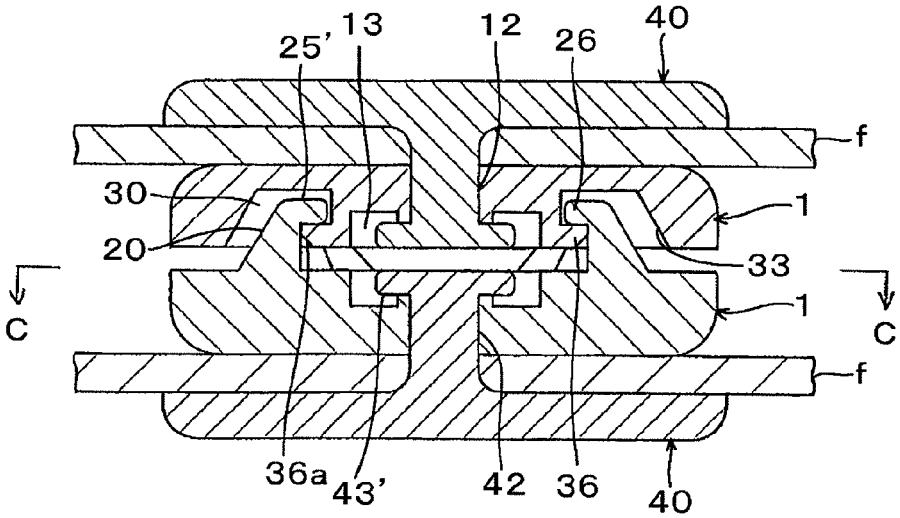
FIG. 7 is a sectional view illustrating a state where two snap buttons have been engaged.
Figure 8:
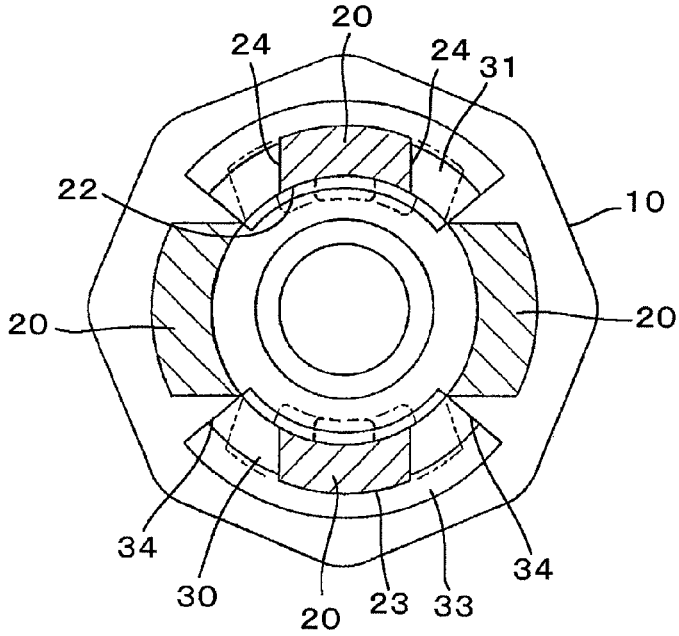
FIG. 8 is a sectional view taken along line C-C of FIG. 7.

FIGS. 6 and 7 are sectional views illustrating respectively a state of two snap buttons 1, 1 just before they are engaged and their engaged state, where the snap buttons 1, 1 have been attached to their respective cloths f, f. The upper snap button 1 and the lower snap button 1 are fixed to the cloths f, f as being mutually displaced by about 90 degrees in the circumferential direction so that the projections 20 of the upper snap button 1 are matched with the recesses 30 of the lower snap button 1 and vice versa when they are engaged. However, in such a circumferential arrangement of the two snap button 1,1, strict accuracy is not required because the circumferential range of the opening 31 of the recess 30 is remarkably larger than that of the top 25' of the projection 20. Similarly, circumferential positioning of the upper and lower snap buttons 1, 1 to engage them from the FIG. 6 state can be roughly done. Further, the radial length of the opening 31 is longer than that of the top 25' of the projection 20, and. Furthermore, the slope of the chamfered portion 36*a* of the radially inner side 32 of the opening 31 and the slope of the radially outer side 33 of the recess 30 can serve as a guide to introduce the projection 20 into the recess 30. Accordingly, the two snap buttons 1,1 can be smoothly engaged even if their respective axes are not accurately aligned or one axis inclines to the other axis. When the two snap buttons 1, 1 are engaged and disengaged, the salients 26 of one of the snap buttons 1, 1 and the protrusions 36 of the other come into contact with each other and elastically deformed, and then they are restored just after mutually passing over. FIG. 8 shows a cross-sectional view taken along line C-C of FIG. 7. In the engaged state, there is a little space in the recesses 30, which allows the projections 20 to circumferentially displace somewhat within the recesses 30. Accordingly, for example, when one cloth f on which one snap button 1 has been fixed is pulled and a force is exerted to cause the one snap button 1 to circumferentially displace relative to the other button 1, it is possible to relieve the force while the one snap button 1 circumferentially moves somewhat relative to the other. Therefore, the snap buttons 1, 1 are not easily disengaged.

Figure 9:
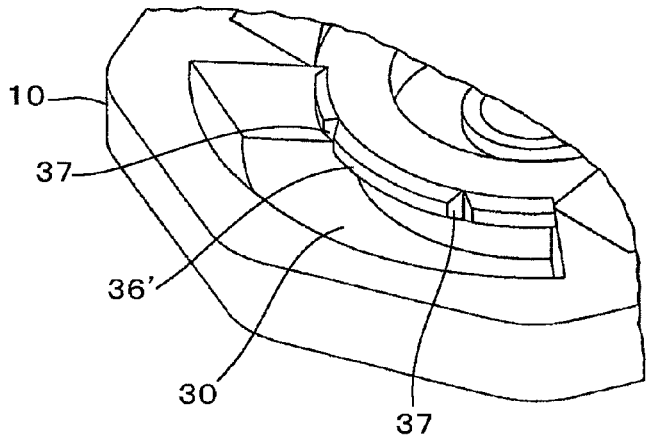
FIG. 9 is a partial perspective view showing a modified example of an upper protrusion.
Figure 1:
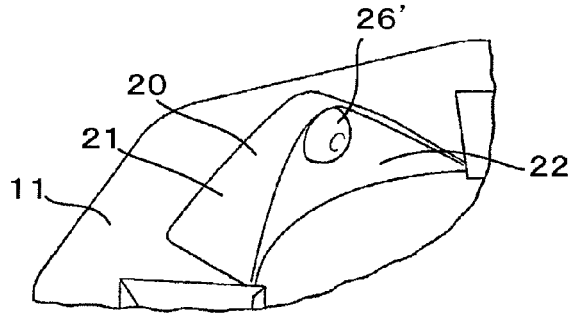

FIG. 9 shows a modified example of the upper protrusion of the recess 30. The protrusion 36' includes a plurality of cutouts 37 (two cutouts 37 is shown in FIG. 9 for example) circumferentially arranged therein. The cutouts 37 can make the protrusion 36' more elastically deformable against the salient 26 when the buttons 1,1 are engaged and disengaged. FIG. 10 shows a modified example of the salient of the projection 20. The salient 26' is hemispherically shaped protruding from the inward face 22 of the projection body 21. The salient 26' can more easily pass over the protrusion 36 when two buttons 1,1 are engaged and disengaged.

As described above, with the snap buttons 1 according to the present invention, the engagement and disengagement between the two snap buttons 1, 1 can be performed easily and smoothly since accurate alignment or positioning of the buttons in the circumferential direction and the axial direction is not required.

DESCRIPTION OF REFERENCE NUMBERS

1 snap button
10 button body
11 upper surface (of the button body)
20 projection
26, 26' salient
30 recess
31 opening
33 radially outer side (in the recess)
36, 36' protrusion
36*a* chamfered portion
37 cutout

The invention claimed is:

1. A snap button made of resin which can function as both a male snap and a female snap to be used in a pair, comprising a plate-like button body;

wherein the button body includes a plurality of projections projecting from a surface of the button body and a plurality of recesses recessed from the surface to detachably receive the projections of a separate and same snap button, the projections and the recesses being circumferentially alternately arranged with respect to the center of the button body;

a circumferential range of each of the recesses is larger than that of each of the projections;

each of the projections includes at least one salient protruding radially inward at a projecting end portion of each projection; and each of the recesses includes at least one protrusion protruding radially outward at a radially inner side of an opening to engage with the salient of each projection of the separate and same snap button when the recesses receives the projections, the opening being open on the surface of the button body.

2. The snap button according to claim 1, wherein each of the projections is projected from the surface of the button body while a horizontal cross-section of each projection gradually decreases.

3. The snap button according to claim 2, wherein each of the projections which has a radially inward face, a radially outward face, and bilateral side faces between the inward face and the outward face;

the salient protruding from an upper end portion of the inward face of the projection body;

the outward face is an inclined face inclined to be gradually close toward the inward face from the base end to the projecting end of each projection; and the bilateral side faces are inclined faces inclined to be gradually close to each other from the base end to the projecting end of each projection.

4. The snap button according any one of claims 1 to 3, wherein the radially inner side of the opening has a chamfered portion.

5. The snap button according to any one of claims 1-3, wherein a radially outer face of the recess is an inclined face inclined radially outward toward the surface of the button body.

6. The snap button according to any one of claims 1-3, wherein the protrusion has one or more cutouts.

7. The snap button according to any one of claims 1-3, wherein the salient is hemispherically shaped.

* * * * *

UNITED STATES PATENT AND TRADEMARK OFFICE

CERTIFICATE OF CORRECTION

PATENT NO. : 8,484,813 B2
APPLICATION NO. : 13/147813
DATED : July 16, 2013
INVENTOR(S) : Katsuhide Taniguchi et al.

It is certified that error appears in the above-identified patent and that said Letters Patent is hereby corrected as shown below:

In the Specifications

In column 2, lines 31-52, delete "As a result, each projection is tapered off from the proximal end to the distal end, which makes it easy to match each projection with each recess. Further, with the tapered projection, it is possible to secure a large cross-section of the projection at the proximal end, which can ensure the strength of the projection. A specific shape of the projection is, for example, as follows: That is, the projection may comprise a projection body having an inward face facing radially inward, an outward face facing radially outward, and bilateral side faces between the inward and outward faces; and the salient protruding from an upper end portion of the inward face of the projection body. Here, the outward face may be inclined as gradually closing to the inward face from the proximal end (base end) to the distal end (projecting end), and the bilateral side faces may be inclined so as to be gradually close to each other from the proximal end to the distal end. However, the shape of the projection is not limited to such a shape. By making the outward face and the bilateral side faces inclined, when matching the projection with recess, even if those inclined faces hit an edge etc. of the opening, the matching action would be smoothly done without obstruction due to the hit." and insert the same on Col. 2, Line 30 after "decreases." as the continuation of the same paragraph.

In column 4, line 22, delete "24,24" and insert -- 24, 24 --, therefor.

In column 4, line 64, delete "34,34" and insert -- 34, 34 --, therefor.

In column 5, line 40, delete "1,1," and insert -- 1, 1, --, therefor.

In column 5, line 51, delete "1,1" and insert -- 1, 1 --, therefor.

In column 6, line 6, delete "1,1" and insert -- 1, 1 --, therefor.

In column 6, line 11, delete "1,1" and insert -- 1, 1 --, therefor.

Signed and Sealed this
Twenty-ninth Day of October, 2013

Teresa Stanek Rea

Teresa Stanek Rea
*Deputy Director of the United States Patent and Trademark Office*

In the Claims

In column 6, line 51, in claim 1, delete “opening to” and insert -- opening of each recess to --, therefor.

In column 6, line 60, in claim 3, delete “projections which” and insert -- projections includes a projection body which --, therefor.

In column 7, line 4, in claim 4, delete “according any one” and insert -- according to any one --, therefor.